US009725665B2

(12) United States Patent
Niitsuma

(10) Patent No.: US 9,725,665 B2
(45) Date of Patent: Aug. 8, 2017

(54) KEROSENE BASE MATERIAL PRODUCTION METHOD AND KEROSENE BASE MATERIAL

(75) Inventor: Takuya Niitsuma, Tokyo (JP)

(73) Assignees: JAPAN OIL, GAS AND METALS NATIONAL CORPORATION, Tokyo (JP); INPEX CORPORATION, Tokyo (JP); JX NIPPON OIL & ENERGY CORPORATION, Tokyo (JP); JAPAN PETROLEUM EXPLORATION CO., LTD., Tokyo (JP); COSMO OIL CO., LTD., Tokyo (JP); NIPPON STEEL & SUMIKIN ENGINEERING CO., LTD., Tokyo (JP)

( * ) Notice: Subject to any disclaimer, the term of this patent is extended or adjusted under 35 U.S.C. 154(b) by 683 days.

(21) Appl. No.: 14/007,722

(22) PCT Filed: Mar. 26, 2012

(86) PCT No.: PCT/JP2012/057774

§ 371 (c)(1),
(2), (4) Date: Dec. 30, 2013

(87) PCT Pub. No.: WO2012/133326

PCT Pub. Date: Oct. 4, 2012

(65) Prior Publication Data

US 2014/0305839 A1 Oct. 16, 2014

(30) Foreign Application Priority Data

Mar. 31, 2011 (JP) ..... 2011-080650

(51) Int. Cl.

| | |
|---|---|
| ***C10L 1/00*** | (2006.01) |
| ***C10L 1/04*** | (2006.01) |
| ***C10G 45/00*** | (2006.01) |

(52) U.S. Cl.
CPC ..... *C10L 1/04* (2013.01); *C10G 45/00* (2013.01); *C10G 2300/1022* (2013.01);
(Continued)

(58) Field of Classification Search
CPC .... C10G 2300/1022; C10G 2300/1044; C10G 2300/1048; C10G 2300/1051; C10G 2300/1055
See application file for complete search history.

(56) References Cited

U.S. PATENT DOCUMENTS

2004/0149627 A1* 8/2004 Koide ..... C10L 1/04 208/15
2005/0145539 A1* 7/2005 Shibuya ..... C10L 1/04 208/15

(Continued)

FOREIGN PATENT DOCUMENTS

AU 2007216008 B2 8/2007
CN 1723267 1/2006

(Continued)

OTHER PUBLICATIONS

Extended European Search Report of EP Patent Application No. 12764548.9 mailed Sep. 29, 2014.

(Continued)

*Primary Examiner* — Randy Boyer
*Assistant Examiner* — Juan Valencia
(74) *Attorney, Agent, or Firm* — Greenblum & Bernstein P.L.C.

(57) ABSTRACT

A process for producing a kerosene base fuel according to the present invention comprises removing paraffins having carbon number of 7 or less from a first fraction having an initial boiling point of 95 to 140° C. and a final boiling point of 240 to 280° C. obtained from a hydrotreated oil of a Fischer-Tropsch synthetic oil to obtain a second fraction (Continued)

having a content of paraffins having carbon number of 7 or less of 0.1 to 0.7% by mass.

2 Claims, 2 Drawing Sheets

(52) U.S. Cl.
CPC ... *C10G 2300/301* (2013.01); *C10G 2400/08* (2013.01); *C10L 2200/043* (2013.01); *C10L 2200/0492* (2013.01)

(56) References Cited

U.S. PATENT DOCUMENTS

| | | | | |
|---|---|---|---|---|
| 2010/0300933 | A1* | 12/2010 | Tanaka | C10G 45/58 208/62 |
| 2012/0004329 | A1 | 1/2012 | Iwama | |

FOREIGN PATENT DOCUMENTS

| | | |
|---|---|---|
| CN | 101717656 | 6/2010 |
| EP | 2199373 A1 | 6/2010 |
| EP | 2 412 784 | 2/2012 |
| JP | 2004-182854 | 7/2004 |
| JP | 2005-179532 | 7/2005 |
| JP | 2007-211217 | 8/2007 |
| WO | 2004/050804 | 6/2004 |
| WO | 2005/059062 | 6/2005 |
| WO | 2007/055935 | 5/2007 |
| WO | 2009-041478 | 4/2009 |
| WO | 2010-109817 | 9/2010 |

OTHER PUBLICATIONS

Office Action for Chinese Patent Application No. 201280014180.8, which was mailed on Jun. 5, 2014.
International Preliminary Report on Patentability for PCT/JP2012/057774, mailed on Oct. 17, 2013.
International Search Report for PCT/JP2012/057774, mailed on May 1, 2012.
Zefirov, "Kerosene", *The Chemical Encyclopedia*, 1995, along with an English language abstract thereof.
Eurasian Patent Organization Office Action for Application No. 201391424, issued Apr. 16, 2015.
European Office Action issued with respect to Application No. 12764548.9, dated May 8, 2017.

* cited by examiner

KEROSENE BASE MATERIAL PRODUCTION METHOD AND KEROSENE BASE MATERIAL

TECHNICAL FIELD

The present invention relates to a process for producing a kerosene base fuel, and a kerosene base fuel.

BACKGROUND ART

As a process for producing a kerosene base fuel to be used as a raw material of liquid fuel products such as kerosene and gas oil, a method using a Fischer-Tropsch synthesis reaction (hereinafter, referred to as the "FT synthesis reaction") in which a synthetic gas containing carbon monoxide gas (CO) and hydrogen gas ($H_2$) as main components is used as a raw material has been known.

For example, Patent Literature 1 discloses a fuel producing process to obtain a naphtha fraction, a kerosene fraction, a gas oil fraction, and an uncracked wax from a hydrotreated oil obtained by hydrotreating or hydrocracking a Fischer-Tropsch synthetic oil (hereinafter referred to as a FT synthetic oil) obtained by the FT synthesis reaction.

CITATION LIST

Patent Literature

[Patent Literature 1] International Publication No. WO 2009/041478

SUMMARY OF INVENTION

Technical Problem

In the production of a kerosene base fuel, in order to be adapted to JIS No. 1-kerosene standard, evacuation from a fractionator is performed without causing a flashing point of a kerosene fraction to be below 40° C. In the above fuel production process, a temperature to separate a naphtha fraction and a kerosene fraction, that is, an initial boiling point of the kerosene fraction is set to around 150° C. to obtain a kerosene fraction containing paraffins having carbon number of 10 to 14 as a main component.

On the other hand, for the reason that a naphtha fraction obtained from the hydrotreated oil derived from the FT synthetic oil has a low octane number because paraffin is a main component thereof, and is unsuitable for automotive fuel, it is desirable to increase a fraction obtained as the kerosene base fuel having a high market value as much as possible.

The present invention has been made in consideration of such circumstances, and an object of the present invention is to provide: a process for producing a kerosene base fuel which allows production of more kerosene base fuel from a hydrotreated oil derived from a FT synthetic oil; and a kerosene base fuel.

Solution to Problem

In order to solve the problems, the present invention provides a process for producing a kerosene base fuel, comprising removing paraffins having carbon number of 7 or less from a first fraction having an initial boiling point of 95 to 140° C. and a final boiling point of 240 to 280° C. obtained from a hydrotreated oil of a Fischer-Tropsch synthetic oil to obtain a second fraction having a content of paraffins having carbon number of 7 or less of 0.1 to 0.7% by mass.

According to the process for producing a kerosene base fuel of the present invention, the specific first fraction is obtained and paraffins having carbon number of 7 or less is removed from the first fraction, thereby making it possible to obtain the specific second fraction as a kerosene base fuel having a flashing point of 40° C. or more. The specific first fraction can contain paraffins having carbon number of 9 or less which have been removed in the conventional kerosene fractions, whereby more fractions can be obtained from the hydrotreated oil of the FT synthetic oil as the kerosene base fuel. Note that the above effect according to the present invention is based on such knowledge of the inventors of the present invention that even if all of paraffins having carbon number of 9 or less are not decreased, the flashing point can be improved sufficiently by leaving paraffins having carbon number of 9 and adjusting paraffins having carbon number of 7 or less within the above specific range.

Note that if a content of paraffins having carbon number of 7 or less in the second fraction exceeds 0.7% by mass, it is difficult to satisfy the condition that the flashing point is 40° C. or more, and if the content is less than 0.1% by mass, costs and troubles required for removing paraffins having carbon number of 7 or less are increased.

In the process for producing a kerosene base fuel according to the present invention, a flashing point of the second fraction can be 40 to 50° C.

The present invention also provides a kerosene base fuel comprising 85 to 99.5% by mass of paraffins having carbon number of 9 to 14 and 0.1 to 0.7% by mass of paraffins having carbon number of 7 or less, wherein a mass ratio $[C_9/C_7^-]$ is 20 or more, where $C_9$ represents a content, % by mass, of paraffins having carbon number of 9 and $C_7^-$ represents a content, % by mass, of paraffins having carbon number of 7 or less.

According to the kerosene base fuel of the present invention, with the above configuration, kerosene having a flashing point of 40° C. or more can be obtained.

Advantageous Effects of Invention

According to the present invention, it is possible to provide: a process for producing a kerosene base fuel which allows production of a larger amount of a kerosene base fuel from a hydrotreated oil derived from a FT synthetic oil; and a kerosene base fuel.

DESCRIPTION OF EMBODIMENTS

Figure 1:
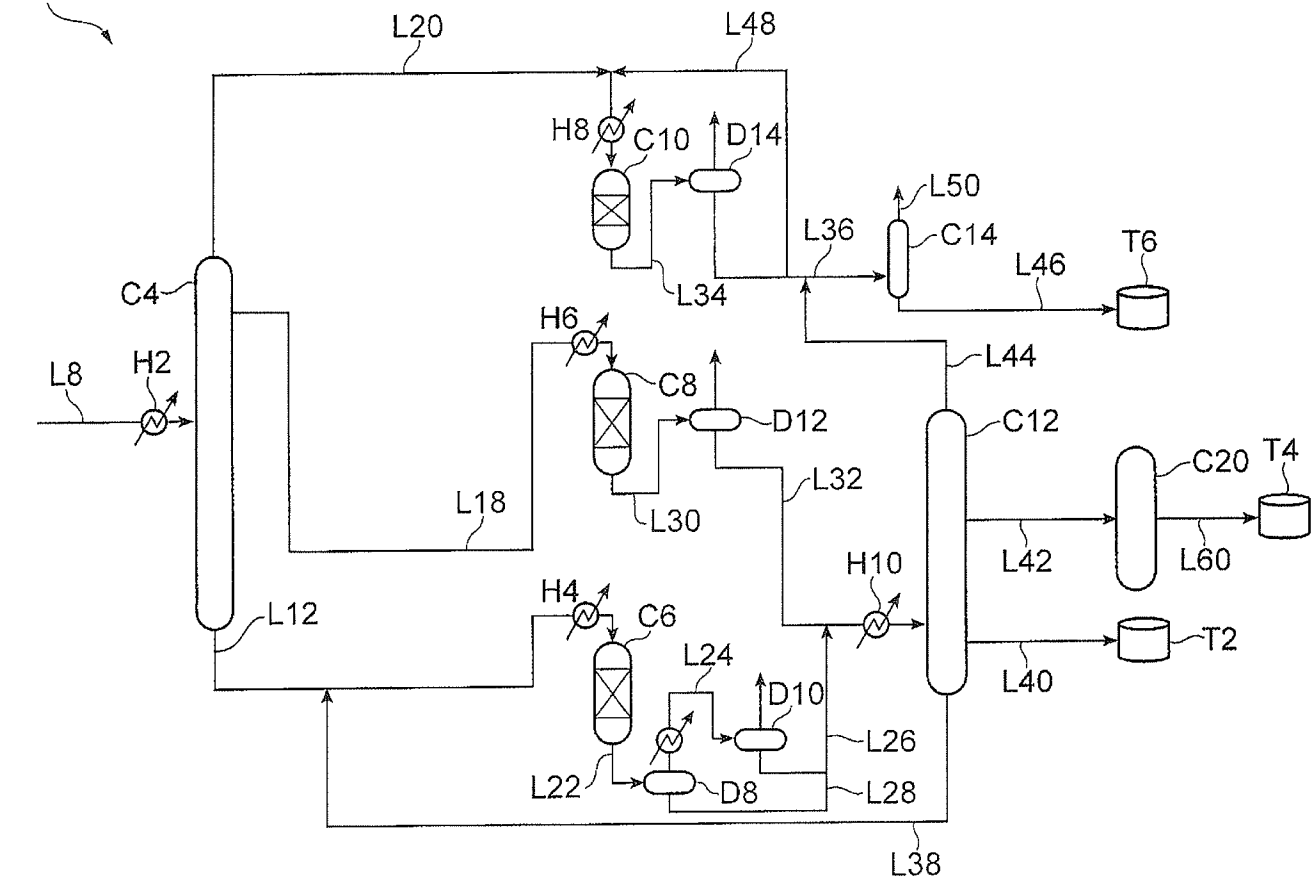
FIG. 1 is a schematic view showing one embodiment of a production system of a hydrocarbon oil on which the process for producing a kerosene base fuel according to the present invention is performed.

With reference to FIG. 1, the following describes the present invention. FIG. 1 is a schematic view showing one embodiment of a production system for a hydrocarbon oil on which a process for producing a kerosene base fuel according to the present invention is performed. Note that the same reference character is assigned to the same or equivalent element.

A production system 100 for a hydrocarbon oil to be used in the present embodiment is a plant facility for producing a base stock for liquid-fuel (hydrocarbon-oil) such as gas oil, kerosene, and naphtha from a Fischer-Tropsch synthetic oil (FT synthetic oil). The production system 100 for a hydrocarbon oil of the present embodiment receives a feed of the FT synthetic oil via a line L8 from a FT synthesis reaction apparatus (not shown) for synthesizing a hydrocarbon oil (the FT synthetic oil) by a FT synthesis reaction from synthesis gas (mixed gas of carbon monoxide gas and hydrogen gas) as a raw material. Note that the FT synthesis reaction apparatus receives a feed of the synthesis gas from a reforming reactor (not shown) for producing the synthesis gas by reforming natural gas. The production system 100 for a hydrocarbon oil mainly includes a first fractionator C4, a hydrocracking reactor C6, a middle distillate hydrotreating apparatus C8, a naphtha fraction hydrotreating apparatus C10, a second fractionator C12, and a flashing-point improvement apparatus C20. To the first fractionator C4, the line L8 where the FT synthetic oil is fed is connected. To the second fractionator C12, a line L32 where a hydrocracked oil and a hydrotreated oil obtained in the hydrocracking reactor C6 and the middle distillate hydrotreating apparatus C8 are fed is connected. To the flashing-point improvement apparatus C20, a line L42 where a predetermined fraction obtained in the second fractionator C12 is fed and a line L60 for evacuating a kerosene base fuel obtained from a predetermined fraction are connected. Note that a "line" means a pipe for transferring a fluid.

First, a process for producing a base stock for liquid fuel (hydrocarbon oil) according to the present embodiment using the production system 100 is described. The method according to the present embodiment includes steps S1 to S6 as follows.

In step S1, the FT synthetic oil is fractionated into a distillate oil and a bottom oil in the first fractionator C4. In the present embodiment, the FT synthetic oil is separated into a raw naphtha fraction, a raw middle distillate, and a raw wax fraction by this fractionating. Here, the raw naphtha fraction and the raw middle distillate are distillate oils which are evacuated separately from the top and the middle of the first fractionator C4 after having vaporized once from the FT synthetic oil and then having been condensed in the first fractionator C4, and the raw wax fraction is a bottom oil evacuated from the bottom as a liquid without vaporizing from the FT synthetic oil. Note that the raw naphtha fraction, the raw middle distillate, and the raw wax fraction are fractions each obtained from the FT synthetic oil by fractionating, and refer to ones which are not subjected to a hydrotreating or hydrocracking.

In step S2, hydrocracking of the raw wax fraction separated in step S1 is performed in the hydrocracking reactor C6.

In step S3, hydrotreating of the raw middle distillate separated in step S1 is performed in the middle distillate hydrotreating apparatus C8.

In step S4, hydrotreating of the raw naphtha fraction is performed in the naphtha fraction hydrotreating apparatus C10. Further, the hydrotreated naphtha fraction is fractionated in a naphtha stabilizer C14 to recover naphtha (GTL-naphtha) which is a product of a GTL process.

In step S5, a mixture (a hydrotreated oil) of a hydrocracked product (a hydrocracked oil) of the raw wax fraction and a hydrotreated product (a hydrotreated oil) of the raw middle distillate is fractionated in the second fractionator C12. By this fractionating, a predetermined first fraction according to the present invention, a fraction which is lighter than the first fraction, and a fraction which is heavier than the first fraction are obtained. The fraction which is lighter than the first fraction is fractionated together with the naphtha fraction obtained in step S4 in the naphtha stabilizer C14 to be recovered as naphtha (G L-naphtha) which is a product of the GTL process. The fraction which is heavier than the first fraction is recovered as a base stock for gas oil (GTL-gas oil) which is a product of the GTL process.

In step S6, paraffins having carbon number of 7 or less are removed from the first fraction obtained in step S5 in the flashing-point improvement apparatus C20 to obtain a second fraction in which a content of paraffins having carbon number of 7 or less is 0.1 to 0.7% by mass. The second fraction is evacuated from the line L60 to be recovered as a kerosene base fuel (GTL-kerosene) which is a product of the GIL process.

Hereinafter, steps S1 to S6 are separately described more in detail.

(Step S1)

In step S1, the FT synthetic oil fed through the line L8 is fractionated in the first fractionator C4. Note that the FT synthetic oil is fed to the first fractionator C4 after it is heated in a heat exchanger H2 provided on the line L8. By this fractionating, the FT synthetic oil is separated into a raw naphtha fraction with substantially $C_5$ to $C_8$ and with a boiling point of lower than about 130° C., a raw middle distillate with substantially $C_9$ to $C_{21}$ and with a boiling point of about 130 to 360° C., and a raw wax fraction with substantially $C_{22}$ or more and with a boiling point of higher than about 360° C.

The raw naphtha fraction is evacuated through a line L20 connected to the top of the first fractionator C4. The raw middle distillate is evacuated through a line L18 connected to the center portion of the first fractionator 40. The raw wax fraction is evacuated through a line L12 connected to the bottom of the first fractionator C4.

(Step S2)

The raw wax fraction transferred from the first fractionator C4 in step S1 as well as hydrogen gas fed by a hydrogen gas feed line (not shown) connected to the line L12 are heated to a temperature necessary for the hydrocracking of the raw wax fraction by a heat exchanger H4 provided on the line L12, and then fed to the hydrocracking reactor C6 to be hydrocracked. Note that a raw wax fraction (hereinafter referred to as an "uncracked wax fraction" in some cases) which has not been hydrocracked sufficiently in the hydrocracking reactor C6 is recovered as a bottom oil of the second fractionator C12 in step S5, recycled to the line L12 by a line L38, and fed again to the hydrocracking reactor C6.

The form of the hydrocracking reactor C6 is not particularly limited, and a fixed bed flow reactor packed with a hydrocracking catalyst is preferably used. The reactor may be a single reactor, or a plurality of reactors provided in series or parallel. Further, as a catalyst bed in the reactor, a single catalyst bed or a plurality of catalyst beds may be provided.

A well-known hydrocracking catalyst is used as the hydrocracking catalyst packed into the hydrocracking reactor C6, and a catalyst in which a metal having hydrogenation activity and belonging to Group 8 to Group 10 in the periodic table of the elements is supported by an inorganic catalyst support having solid acidity is preferably used.

Examples of the preferable inorganic catalyst support having solid acidity which constitutes the hydrocracking catalyst include those constituted by zeolites such as ultra-stable Y-type (USY) zeolite, Y-type zeolite, mordenite, and β zeolite, and one or more inorganic compounds selected from amorphous composite metal oxides having heat resistance such as silica alumina, silica zirconia, and alumina boria. Further, the catalyst support is more preferably a composition constituted by containing USY zeolite and one or more amorphous composite metal oxides selected from silica alumina, alumina boria, and silica zirconia, and further preferably a composition constituted by containing USY zeolite and alumina boria and/or silica alumina.

USY zeolite is one obtained by ultra-stabilizing Y-type zeolite by a hydrothermal treatment and/or an acid treatment; in addition to a fine porous structure called micro pores that Y-type zeolite originally has and whose pore size is not larger than 2 nm, new pores having a pore size in the range of 2 to 10 nm are formed. The average particle size of USY zeolite is not particularly limited, but it is preferably not larger than 1.0 μm, and more preferably not larger than 0.5 μm. Moreover, in USY zeolite, it is preferable that a molar ratio of silica/alumina (molar ratio of silica to alumina) be 10 to 200, and it is more preferable that the molar ratio be 15 to 100, and it is further preferable that the molar ratio be 20 to 60.

Moreover, it is preferable that the catalyst support contain 0.1 to 80% by mass of a crystalline zeolite and 0.1 to 60% by mass of an amorphous composite metal oxide having heat resistance.

The catalyst support can be produced as follows: a catalyst support containing the inorganic compound having solid acidity and a binder is molded, and calcined. The proportion of the inorganic compound having solid acidity to be compounded is preferably 1 to 70% by mass, and more preferably 2 to 60% by mass based on the entire mass of the catalyst support. Moreover, in the case where the catalyst support contains USY zeolite, the proportion of USY zeolite to be compounded is preferably 0.1 to 10% by mass, and more preferably 0.5 to 5% by mass based on the entire mass of the catalyst support. Further, in the case where the catalyst support contains USY zeolite and alumina boria, it is preferable that the proportion of USY zeolite to alumina boria to be compounded (USY zeolite/alumina boria) be 0.03 to 1 in the mass ratio. Moreover, in the case where the catalyst support contains USY zeolite and silica alumina, it is preferable that the proportion of USY zeolite to silica alumina to be compounded (USY zeolite/silica alumina) be 0.03 to 1 in the mass ratio.

The binder is not particularly limited, but alumina, silica, titania, and magnesia are preferable, and alumina is more preferable. The amount of the binder to be compounded is preferably 20 to 98% by mass, and more preferably 30 to 96% by mass based on the entire mass of the catalyst support.

A temperature of calcining the catalyst support is preferably in the range of 400 to 550° C., more preferably in the range of 470 to 530° C., and further preferably in the range of 490 to 530° C. By calcination at such a temperature, sufficient solid acidity and mechanical strength can be given to the catalyst support.

Examples of that metal having hydrogenation activity and belonging to Group 8 to Group 10 in the periodic table which is supported by the catalyst support specifically include cobalt, nickel, rhodium, palladium, iridium, and platinum. Among them, metals selected from nickel, palladium, and platinum are preferably used solely or in combinations of two or more thereof. These metals can be supported by the catalyst support mentioned above by a standard method such as impregnation and ion exchange. The amount of the metal to be supported is not particularly limited, but it is preferable that the entire amount of the metal be 0.1 to 3.0% by mass relative to the mass of the catalyst support. Note that the periodic table of the elements here refers to the long form of the periodic table of the elements based on the regulation of IUPAC (the International Union of Pure and Applied Chemistry).

In the hydrocracking reactor C6, a part of the raw wax fraction and the uncracked wax fraction (hydrocarbons with approximately $C_{21}$ or more) is converted into hydrocarbons with approximately $C_{21}$ or less by hydrocracking, but a part thereof is further converted into the naphtha fraction (with approximately $C_5$ to $C_8$) which is lighter than an intended middle distillate (with approximately $C_9$ to $C_{21}$) due to excessive cracking, and furthermore converted into gaseous hydrocarbons with $C_4$ or less. On the other hand, a part of the raw wax fraction and the uncracked wax fraction is not hydrocracked sufficiently, and remains as uncracked wax fractions with approximately $C_{22}$ or more. A composition of the hydrocracked product is determined by a hydrocracking catalyst to be used and hydrocracking reaction conditions. Note that the "hydrocracked product" here refers to all hydrocracked products including the uncracked wax fraction unless otherwise specified. When the hydrocracking reaction conditions are made severer than required, a content of the uncracked wax fraction in the hydrocracked product decreases, which increases light fractions which are lighter than the naphtha fraction, thereby decreasing a yield of the intended middle distillate. On the other hand, when the hydrocracking reaction conditions are made more moderate than required, the uncracked wax fraction increases, thereby decreasing the yield of the middle distillate. When a ratio M2/M1 of a mass M2 cracked products with a boiling point of 25 to 360° C. to a mass M1 of all cracked products with a boiling point of 25° C. or more is referred to as a "cracking rate," the reaction conditions are generally selected so that this cracking rate M2/M1 is 30 to 90%, preferably 40 to 85%, and further preferably 45 to 80%.

In the hydrocracking reactor C6, in parallel with the hydrocracking reaction, a hydro-isomerization reaction of the raw wax fraction and the untracked wax fraction or normal paraffins that constitute a hydrocracked product thereof proceeds to produce isoparaffins. In the case where the hydrocracked product is used as a base stock for fuel oil, the isoparaffins produced by the hydro-isomerization reaction are a component contributing to improvement in cold flow property (fluidity in a low temperature), and it is preferable that the production rate be high. Further, the removal of oxygen-containing compounds such as olefins and alcohols that are a by-product of the FT synthesis reaction, contained in the raw wax fraction, also proceeds. That is, olefins are converted into paraffin hydrocarbons by hydrogenation, and the oxygen-containing compounds are converted into paraffin hydrocarbons and water by hydrogenation deoxidation.

The reaction conditions in the hydrocracking reactor C6 are not limited, but the following reaction conditions can be selected. Namely, examples of the reaction temperature include 180 to 400° C., but 200 to 370° C. is preferable, 250 to 350° C. is more preferable, and 280 to 350° C. is particularly preferable. If the reaction temperature is higher than 400° C., not only cracking into the light fraction tends to proceed to decrease the yield of the middle distillate, but also the product tends to be colored and to be restricted to use as the base stock for fuel oil. On the other hand, if the reaction temperature is lower than 180° C., the hydrocracking reaction does not proceed sufficiently, thereby resulting in that not only the yield of the middle distillate tends to be decreased, but also production of isoparaffins by the hydro-isomerization reaction tends to be suppressed, and oxygen-containing compounds such as alcohols tend not to be sufficiently removed, and remain. Examples of the hydrogen partial pressure include 0.5 to 12 MPa, and 1.0 to 5.0 MPa is preferable. If the hydrogen partial pressure is lower than 0.5 MPa, hydrocracking and hydro-isomerization tend not to sufficiently proceed, but on the other hand, if the hydrogen partial pressure is higher than 12 MPa, high pressure resistance is demanded for the apparatus, and facility cost tends to increased. Examples of the liquid hourly space velocity (LHSV) of the raw wax fraction and the uncracked wax fraction include 0.1 to 10.0 $h^{-1}$, and 0.3 to 3.5 $h^{-1}$ is preferable. If the LHSV is lower than 0.1 $h^{-1}$, hydrocracking tends to proceed excessively and productivity tends to be decreased, but on the other hand, if the LHSV is higher than 10.0 $h^{-1}$, hydrocracking, hydro-isomerization, and the like tend not to sufficiently proceed. Examples of the ratio of hydrogen/oil include 50 to 1000 NL/L, and 70 to 800 NL/L is preferable. If the ratio of hydrogen/oil is lower than 50 NL/L, hydrocracking, hydro-isomerization, and the like tend not to sufficiently proceed, but on the other hand, if the ratio of hydrogen/oil is higher than 1000 NL/L, a large-sized hydrogen feeding apparatus and the like tend to be needed.

In this example, a hydrocracked product and unreacted hydrogen gas flowing out from the hydrocracking reactor C6 are cooled down at two stages in a gas liquid separator D8 and a gas liquid separator D10 to be separated into gas and liquid, and relatively heavy liquid hydrocarbons containing the uncracked wax fraction is obtained from the gas liquid separator D8 while a gas fraction which mainly contains hydrogen gas and gaseous hydrocarbons with $C_4$ or less, and relatively light liquid hydrocarbons are obtained from the gas liquid separator D10. By such two-stage cooling and gas liquid separation, occurrences of clogging and the like of lines accompanied with solidification by quenching of the uncracked wax fraction contained in the hydrocracked product can be prevented. The respective liquid hydrocarbons obtained in the gas liquid separator D8 and the gas liquid separator D10 flow together into the line L32 through a line L28 and a line L26, respectively. The gas fraction which mainly contains hydrogen gas and gaseous hydrocarbons with $C_4$ or less, separated in a gas liquid separator D12, is fed to the middle distillate hydrotreating apparatus C8 and the naphtha fraction hydrotreating apparatus C10 through a line (not shown) connecting the gas liquid separator D10 to the line L18 and the line L20 so that hydrogen gas is reused.

(Step S3)

The raw middle distillate which is evacuated from the first fractionator C4 by the line L18 as well as hydrogen gas fed by a hydrogen gas feed line (not shown) connected to the line L18 are heated to a temperature necessary for hydrotreating of the raw middle distillate by a heat exchanger H6 provided in the line L18, and then fed to the middle distillate hydrotreating apparatus C8 to be hydrotreated.

The form of the middle distillate hydrotreating apparatus C8 is not particularly limited, and a fixed bed flow reactor packed with a hydrotreating catalyst is preferably used. The reactor may be a single reactor, or a plurality of reactors provided in series or parallel. Further, as a catalyst bed in the reactor, a single catalyst bed or a plurality of catalyst beds may be provided.

As the hydrotreating catalyst used in the middle distillate hydrotreating apparatus C8, catalysts usually used for hydrotreating and/or hydro-isomerization in petroleum refining or the like, namely, catalysts in which a metal having hydrogenation activity is supported by an inorganic catalyst support can be used.

As the metal having hydrogenation activity that constitutes the hydrotreating catalyst, one or more metals selected from the group consisting of metals in Groups 6, 8, 9, and 10 in the periodic table of the elements are used. Specific examples of these metals include noble metals such as platinum, palladium, rhodium, ruthenium, iridium, and osmium, or cobalt, nickel, molybdenum, tungsten, and iron; preferable are platinum, palladium, nickel, cobalt, molybdenum, and tungsten, and more preferable are platinum and palladium. Moreover, a plurality of these metals are also preferably used in combination; examples of a preferable combination in this case include platinum-palladium, cobalt-molybdenum, nickel-molybdenum, nickel-cobalt-molybdenum, and nickel-tungsten.

Examples of the inorganic catalyst support that constitutes the hydrotreating catalyst include metal oxides such as alumina, silica, titania, zirconia, and boria. These metal oxides may be used individually, or used as a mixture of two or more thereof, or a composite metal oxide such as silica alumina, silica zirconia, alumina zirconia, and alumina boria. From the viewpoint of efficiently proceeding hydro-isomerization of normal paraffins at the same time of hydrotreating, it is preferable that the inorganic catalyst support be a composite metal oxide having solid acidity such as silica alumina, silica zirconia, alumina zirconia, and alumina boria. Moreover, a small amount of zeolite may be contained in the inorganic catalyst support. Further, in order to enhance the moldability and mechanical strength of the catalyst support, a binder may be compounded in the inorganic catalyst support. Examples of a preferable binder include alumina, silica, and magnesia.

In the case where the metal is the above-described noble metal, it is preferable that the content of the metal having hydrogenation activity in the hydrotreating catalyst be approximately 0.1 to 3% by mass as the metal atom based on the mass of the catalyst support. Moreover, in the case where the metal is a metal other than the above-described noble metal, it is preferable that the content be approximately 2 to 50% by mass as a metal oxide based on the mass of the catalyst support. In the case where the content of the metal having hydrogenation activity is less than the lower limit value, hydrotreating and hydro-isomerization tend not to sufficiently proceed. On the other hand, in the case where the content of the metal having hydrogenation activity is more than the upper limit value, dispersion of the metal having hydrogenation activity tends to be decreased to decrease the activity of the catalyst, and cost of the catalyst is increased.

In the middle distillate hydrotreating apparatus C8, the raw middle distillate (which contains normal paraffins with approximately $C_9$ to $C_{21}$ as a main component) is hydrotreated. In this hydrotreating, olefins that are a by-product of the FT synthesis reaction, contained in the raw middle distillate, are hydrogenated to be converted into paraffin hydrocarbons. Moreover, oxygen-containing compounds such as alcohols are converted into paraffin hydrocarbons and water by hydrogenation dehydrogenation. Moreover, in parallel with the hydrotreating, a hydro-isomerization reaction of normal paraffins that constitute the raw middle distillate proceeds to produce isoparaffins. In the case where the middle distillate is used as the base stock for fuel oil, the isoparaffins produced by the hydro-isomerization reaction are a component contributing to improvement in cold flow property, and it is preferable that its production rate be high.

The reaction condition in the middle distillate hydrogen refining apparatus C8 is not limited, but the following reaction condition can be selected. Namely, examples of the reaction temperature include 180 to 400° C., but 200 to 370° C. is preferable, 250 to 350° C. is more preferable, and 280 to 350° C. is particularly preferable. If the reaction temperature is higher than 400° C., not only cracking into the light fraction tends to proceed to decrease the yield of the middle distillate, but also the product tends to be colored and to be restricted to use as the base stock for fuel oil. On the other hand, if the reaction temperature is lower than 180° C., oxygen-containing compounds such as alcohols tend not to be sufficiently removed to remain, and production of isoparaffins by the hydro-isomerization reaction tends to be suppressed. Examples of the hydrogen partial pressure include 0.5 to 12 MPa, and 1.0 to 5.0 MPa is preferable. If the hydrogen partial pressure is lower than 0.5 MPa, hydrotreating and hydro-isomerization tend not to sufficiently proceed, but on the other hand, if the hydrogen partial pressure is higher than 12 MPa, high pressure resistance is demanded for the apparatus, and facility cost tends to be increased. Examples of the liquid hourly space velocity (LHSV) of the raw middle distillate include 0.1 to 10.0 $h^{-1}$, and 0.3 to 3.5 $h^{-1}$ is preferable. If the LHSV is lower than 0.1 $h^{-1}$, cracking into the light fraction tends to proceed to decrease the yield of the middle distillate, and productivity tends to be decreased, but on the other hand, if the LHSV is higher than 10.0 $h^{-1}$, hydrotreating and hydro-isomerization tend not to sufficiently proceed. Examples of the ratio of hydrogen/oil include 50 to 1000 NL/L, and 70 to 800 NL/L is preferable. If the ratio of hydrogen/oil is lower than 50 NL/L, hydrotreating and hydro-isomerization tend not to sufficiently proceed, but on the other hand, if the ratio of hydrogen/oil is higher than 1000 NL/L, a large-sized hydrogen feeding apparatus and the like tend to be needed.

From an effluent oil of the middle distillate hydrotreating apparatus C8, a gas fraction which mainly contains unreacted hydrogen gas is separated in the gas liquid separator D12 to which a line L30 is connected, and then the effluent oil is transferred through the line L32 to flow with a hydrocracked product of the liquid wax fraction transferred by the line L26. The gas fraction which mainly contains hydrogen gas, separated in the gas liquid separator D12, is fed to the hydrocracking reactor C6 to be reused.

(Step S4)

The raw naphtha fraction evacuated from the first fractionator C4 by the line L20 as well as hydrogen gas fed by a hydrogen gas feed line (not shown) connected to the line L20 are heated to a temperature necessary for hydrotreating of the raw naphtha fraction by a heat exchanger H8 provided in the line L20, and fed to the naphtha fraction hydrotreating apparatus C10 to be hydrotreated.

The form of the naphtha fraction hydrotreating apparatus 10 is not particularly limited, and a fixed bed flow reactor packed with a hydrotreating catalyst is preferably used. The reactor may be a single reactor, or a plurality of reactors provided in series or parallel. Further, as a catalyst bed in the reactor, a single catalyst bed or a plurality of catalyst beds may be provided.

The hydrotreating catalyst for use in the naphtha fraction hydrotreating apparatus 10 is not particularly limited, but may be a hydrotreating catalyst similarly to the one used for the hydrotreating of the raw middle distillate.

In the naphtha fraction hydrotreating apparatus C10, unsaturated hydrocarbons contained in the raw naphtha fraction (which contains normal paraffins with substantially $C_5$ to $C_8$ as a main component) is converted into paraffin hydrocarbons by hydrogenation. Further, oxygen-containing compounds such as alcohols contained in the raw naphtha fraction are converted into paraffin hydrocarbons and water by hydrogenation deoxidation. Note that because the naphtha fraction has few carbon atoms, its hydro-isomerization reaction does not proceed so much.

The reaction conditions in the naphtha fraction hydrotreating apparatus C10 are not limited, but reaction conditions similar to the reaction conditions in the aforementioned middle distillate hydrotreating apparatus C8 can be selected.

An effluent oil of the naphtha fraction hydrotreating apparatus C10 is fed to a gas liquid separator D14 through a line L34, and is separated into a gas fraction containing hydrogen gas as a main component and liquid hydrocarbons in the gas liquid separator D14. The separated gas fraction is fed to the hydrocracking reactor C6, and hydrogen gas contained therein is reused. On the other hand, the separated liquid hydrocarbons are transferred to the naphtha stabilizer C14 through a line L36. Further, a part of the liquid hydrocarbons is recycled through a line L48 to the line L20 that is the upstream of the naphtha fraction hydrotreating apparatus C10. Because a calorific value in the hydrotreating of the raw naphtha fraction (hydrogenation of olefins and hydrogenation deoxidation of alcohols and the like) is large, a part of the liquid hydrocarbons is recycled to the naphtha fraction hydrotreating apparatus C10 to dilute the raw naphtha fraction, thereby suppressing the increase in temperature in the naphtha fraction hydrotreating apparatus C10.

In the naphtha stabilizer C14, the liquid hydrocarbons fed from the naphtha fraction hydrotreating apparatus C10 and the second fractionator C12 are fractionated to obtain purified naphtha with a carbon number of $C_5$ to $C_8$ as a product. This purified naphtha is transferred to a naphtha tank T6 through a line L46 from the bottom of the naphtha stabilizer C14 to be accumulated therein. On the other hand, from a line L50 connected to the top of the naphtha stabilizer C14, hydrocarbon gas containing hydrocarbons having carbon number of a predetermined number or less ($C_4$ or less) is discharged. This hydrocarbon gas is not a target product, and therefore is introduced into external combustion facilities (not shown) and released to the atmosphere after it is burned.

(Step S5)

A mixed oil (a hydrotreated oil) constituted by liquid hydrocarbons (a hydrocracked oil) obtained from the effluent oil from the hydrocracking reactor C6 and liquid hydrocarbons (a hydrotreated oil) obtained from the effluent oil from the middle distillate hydrotreating apparatus C8 is heated by a heat exchanger H10 provided in the line L32, fed to the second fractionator C12, and fractionated into hydrocarbons with approximately $C_8$ or less, a first fraction to obtain a kerosene base fuel, a gas oil fraction, and an uncracked wax fraction. In the present embodiment, the initial boiling point of the first fraction is assumed 95 to 140° C. and the final boiling point is assumed 240 to 280° C. to perform fractionation so that as many paraffins having carbon number of 9 as possible are contained in the first fraction.

The hydrocarbons with approximately $C_8$ or less has a boiling point of lower than about 130° C., and evacuated from the top of the second fractionator C12 by a line L44. This makes it possible to obtain a naphtha composition having a paraffin content of 99% by mass or more, a paraffin content having carbon number of 9 or more of 5% by mass or less, and a mass ratio iP/nP of a content iP of isoparaffins to a content nP of normal paraffins within the range of 0.1 to 0.6. Such a naphtha composition may be used as a raw material of a naphtha cracker (a steam cracker).

In the present embodiment, hydrocarbons with approximately $C_8$ or less evacuated from the top of the second fractionator C12 are fed to a naphtha stabilizer through the lines L44 and L36 to be fractionated with liquid hydrocarbons fed from the naphtha fraction hydrotreating apparatus C10, but they can be evacuated from the line L44 to obtain the naphtha composition.

The first fraction has an initial boiling point of 95 to 140° C. and a final boiling point of 240 to 280° C., but from the viewpoint of increasing a content of a low-boiling-point component in an intended kerosene base fuel, one having a boiling point of 95 to 275° C. is preferable, and one having a boiling point of 95 to 270° C. is more preferable. Further, the distillation characteristic of the first fraction is preferably such that a 5%-distillation temperature (T5) is 138 to 139° C.

Further, it is preferable that a $C_9$ content in the first fraction be 5% by mass or more, but in view of increasing the $C_9$ content in the intended kerosene base fuel, the $C_9$ content is preferably 10% by mass or more, and more preferably 15% by mass or more.

The first fraction is evacuated from the center portion of the second fractionator C12 through the line L42 and transferred to the flashing-point improvement apparatus C20 at the following stage.

The gas oil fraction has a boiling point of about 250 to 360° C. and is evacuated from the lower portion of the second fractionator C12 through a line L40 to be accumulated in a tank T2. The uncracked wax fraction has a boiling point of higher than about 360° C. and is evacuated from the bottom of the second fractionator C12 to be recycled through the line L38 to the line L12 that is the upstream of the hydrocracking reactor C6.

(Step S6)

From the first fraction obtained in the second fractionator C12, paraffins having carbon number of 7 or less are removed by the flashing-point improvement apparatus C20 to obtain a second fraction. The removal of paraffins having carbon number of 7 or less is performed so that a content of paraffins having carbon number of 7 or less in the second fraction is 0.1 to 0.7% by mass. The second fraction is transferred to a tank T4 through the line L60 to be accumulated therein. This second fraction can be directly used as the kerosene base fuel (GTL-kerosene) which is a product of the GTL process.

Examples of the flashing-point improvement apparatus include a flash drum, an ejector, a stabilizer, and the like.

In the present embodiment, it is preferable that the removal of paraffins having carbon number of 7 or less from the first fraction be performed so that a content of paraffins having carbon number of 7 or less in the second fraction is preferably 0.1 to 0.7% by mass, and more preferably 0.1 to 0.5% by mass.

Further, it is preferable that the removal of paraffins having carbon number of 7 or less from the first fraction be performed so that a mass ratio $[C_9/C_7^-]$ is preferably 5 or more, more preferably 10 or more, further more preferably 20 or more, and particularly preferably 30 or more, where $C_9$ represents a content, % by mass, of paraffins having carbon number of 9 in the second fraction and $C_7^-$% represents a content, % by mass, of paraffins having carbon number of 7 or less. That is, such a condition is preferable that paraffins having carbon number of 7 or less can be removed while paraffins having carbon number of 9 are left. Note that, as for paraffins having carbon number of 8, 0.1 to 1.5% by mass is preferable.

The flashing point of the second fraction is preferably 40 to 50° C., more preferably 40 to 47° C., and further more preferably 40 to 45° C. Note that the flashing point is prescribed in JIS K2265 as "a temperature at which a sample steam burns instantaneously with flash light when an ignition source is brought close to the sample steam under regulation conditions and a minimum temperature of the sample at which the flame spreads over a liquid level is normalized to an atmospheric pressure of 101.3 kPa," and it can be measured by a tag closed cup flash point tester or the like.

According to the method of the present embodiment, a kerosene base fuel shown below can be preferably obtained. In the present embodiment, it is preferable that at the initial boiling point and final boiling point of the first fraction in step S5, the removal of paraffins having carbon number of 7 or less in step S6 be performed so that the following kerosene base fuel is obtained.

In view of increasing the yield of the kerosene base fuel while securing a flashing point of 40° C. or more, it is preferable that the kerosene base fuel of the present embodiment contain 85 to 99.5% by mass of paraffins having carbon number of 9 to 14, contain 0.1 to 0.7% by mass of paraffins having carbon number of 7 or less, and have a mass ratio $[C_9/C_7^-]$ of 20 or more, where $C_9$ represents a content, % by mass, of paraffins having carbon number of 9 and $C_7^-$ represents a content, % by mass, of paraffins having carbon number of 7 or less.

It is more preferable for the kerosene base fuel to have a mass ratio $[C_9/C_7^-]$ of 30 or more.

Further, in view of increasing the yield of the kerosene base fuel, the kerosene base fuel has a content of paraffins having carbon number of 9 of preferably 2.5 to 30% by mass, more preferably 5 to 30% by mass, further more preferably 10 to 30% by mass, and particularly preferably 15 to 30% by mass.

The kerosene base fuel is preferably such that a mass ratio iP/nP of a content iP of isoparaffins and a content nP of normal paraffins is 0.5 to 1.5.

The kerosene base fuel has a flashing point of preferably 40 to 50° C., more preferably 40 to 47° C., and further more preferably 40 to 45° C.

The kerosene base fuel obtained according to the present invention is preferably used for production of JIS No. 1-kerosene and jet fuels.

EXAMPLES

Hereinafter, the present invention will be described in more detail by Examples, but the present invention is not to be limited to the following Examples.

Example 1

A hydrotreated oil (with an initial boiling point of 137° C., a final boiling point of 358° C., and iP/nP=0.8) corresponding to the middle distillate derived from the FT synthetic oil was distilled to obtain a first fraction having an initial boiling point of 138° C. and a final boiling point of 252° C. A flashing point of this first fraction was 35.5° C. Note that the flashing point was measured according to JIS K2265.

A part of a paraffin content was removed from the first fraction by use of a flash drum under a condition of a cut temperature of 127° C. to obtain a second fraction having a content of paraffins having carbon number of 9 of 9.2% by mass and a content of paraffins having carbon number of 7 or less of 0.1% by mass. A flashing point of this second fraction was 45.5° C. Further, the yield of the second fraction to the hydrotreated oil corresponding to the middle distillate was 52% by mass.

Example 2

A hydrotreated oil (with an initial boiling point of 133° C., a final boiling point of 355° C., and iP/nP=1.0) derived from the FT synthetic oil was distilled to obtain a first fraction having an initial boiling point of 130° C. and a final boiling point of 248° C. A flashing point of this first fraction was 33.5° C.

A part of a paraffin content was removed from the first fraction by use of a flash drum under a condition of a cut temperature of 122° C. to obtain a second fraction having a content of paraffins having carbon number of 9 of 18.7% by mass and a content of paraffins having carbon number of 7 or less of 0.2% by mass. A flashing point of this second fraction was 43.0° C. Further, the yield of the second fraction to the hydrotreated oil corresponding to the middle distillate was 55% by mass.

Comparative Example 1

A hydrotreated oil (with an initial boiling point of 147° C., a final boiling point of 358° C., and iP/nP=0.9) derived from the FT synthetic oil was distilled to obtain a kerosene fraction having an initial boiling point of 145° C. and a final boiling point of 248° C. A flashing point of this kerosene fraction was 41.0° C. The yield of the second fraction to the hydrotreated oil corresponding to the middle distillate was 50% by mass. Note that, in the kerosene fraction, a content of paraffins having carbon number of 9 was 4.8% by mass and a content of paraffins having carbon number of 7 or less was 0.3% by mass.

Comparative Example 2

A hydrotreated oil (with an initial boiling point of 131° C., a final boiling point of 358° C., and iP/nP=1.3) derived from the FT synthetic oil was distilled to obtain a fraction having an initial boiling point of 128° C. and a fmal boiling point of 255° C. A flashing point of this fraction was 38.0° C.

<Measurement of a Flashing Point of a Base Stock for GTL-Kerosene>

Figure 2:
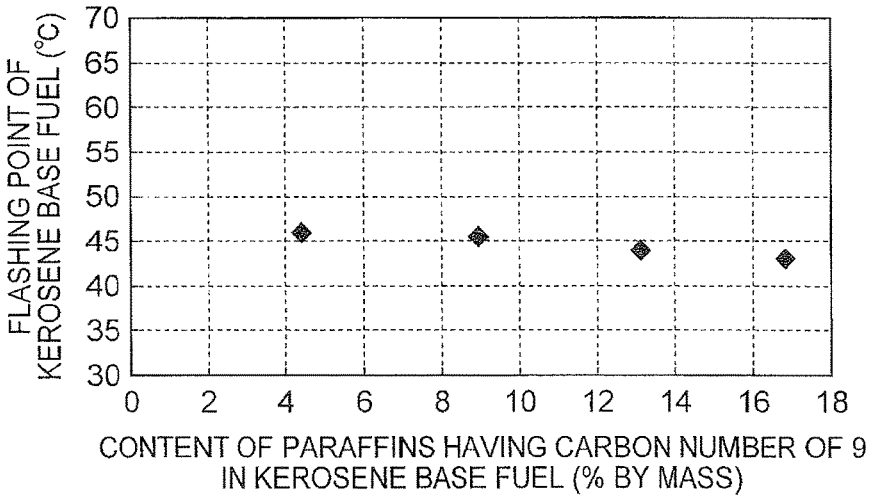
FIG. 2(*a*) is a view showing a relation between a content of paraffin having carbon number of 9 in a kerosene base fuel and a flashing point of the kerosene base fuel, and FIG. 2(*b*) is a view showing a relation between a paraffin content having carbon number of 7 or less in the kerosene base fuel and the flashing point of the kerosene base fuel.
Figure 2:
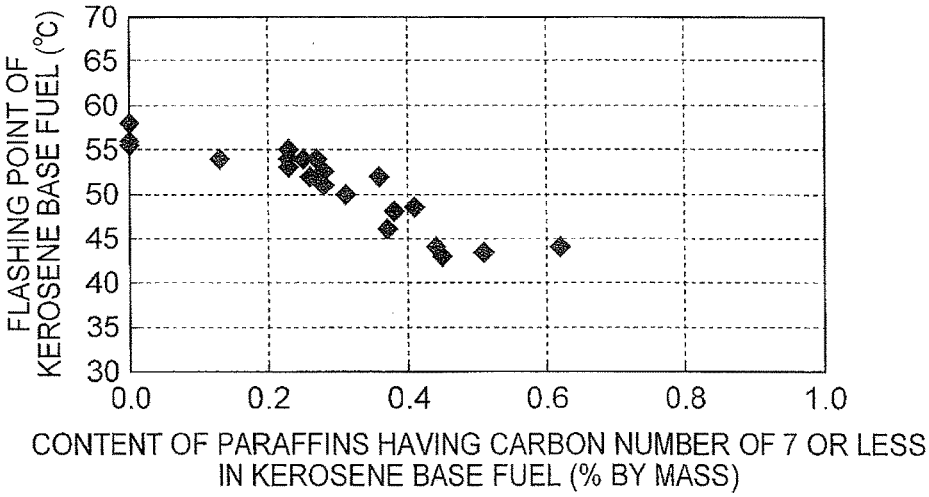

A hydrotreated oil (with an initial boiling point of 140° C., a final boiling point of 361° C., and iP/nP=1.4) derived from the FT synthetic oil was distilled to obtain a base stock for GTL-kerosene having an initial boiling point of 138° C. and a final boiling point of 261° C. (with a content of paraffins having carbon number of 9 of 4.4% by mass, a content of paraffins having carbon number of 7 or less of 0.37% by mass, and iP/nP=0.91), and the changes in flashing point were examined while paraffins having carbon number of 9 was added thereto (in addition amounts of 0, 5, 10, and 15% by mass). FIG. 2(*a*) shows a relation between a content of paraffin having carbon number of 9 in the kerosene base fuel and the flashing point of the kerosene base fuel. Respective flashing points at the addition amounts of 0, 5, 10, and 15% by mass were 46.0° C., 45.5° C., 44.0° C., and 43.0° C.

From a first fraction having an initial boiling point of 133° C. and a final boiling point of 250° C. obtained by distilling a hydrotreated oil (with an initial boiling point of 131° C., a final boiling point of 358° C., and iP/nP=1.3) derived from the FT synthetic oil, removal of a part of a paraffin content was performed by an ejector to obtain several types of second fractions having different contents of paraffins having carbon number of 7 or less. Note that, the second fractions having different contents of paraffins having carbon number of 7 or less were obtained here by changing conditions of the pressure in the ejector.

Respective flashing points of the second fractions obtained as above were measured to find a relation between the paraffin content having carbon number of 7 or less in the second fraction and the flashing point. FIG. 2(*b*) shows a relation between the paraffin content having carbon number of 7 or less in the kerosene base fuel (the second fraction) and the flashing point of the kerosene base fuel (the second fraction).

INDUSTRIAL APPLICABILITY

According to the present invention, it is possible to provide: a process for producing a kerosene base fuel which allows production of a larger amount of a kerosene base fuel from a hydrotreated oil derived from a FT synthetic oil; and a kerosene base fuel.

REFERENCE SIGNS LIST

C4 . . . first fractionator, C6 . . . hydrocracking reactor, C8 . . . middle distillate hydrotreating apparatus, C10 . . . naphtha fraction hydrotreating apparatus, C12 . . . second fractionator, C20 . . . flashing-point improvement apparatus, 100 . . . production system for hydrocarbon oil.

The invention claimed is:

1. A process for producing a kerosene base fuel, comprising:

removing paraffins having a carbon number of 7 or less from a first fraction to obtain a second fraction that has a content of paraffins having a carbon number of 7 or less that is from 0.1 to 0.7% by mass, wherein the first fraction is obtained by distilling a hydrotreated oil of a Fischer-Tropsch synthetic oil and has an initial boiling point of 95 to 140° C. and a final boiling point of 240 to 280° C.

2. The process for producing a kerosene base fuel according to claim 1, wherein the flashing point of the second fraction is 40 to 50° C.

* * * * *